United States Patent [19]

Baeck et al.

[11] Patent Number: 5,050,647

[45] Date of Patent: Sep. 24, 1991

[54] DAMAGED WEFT THREAD ELIMINATION IN AIRJET WEAVING MACHINES

[75] Inventors: Robert Baeck, De Pinte; Dirk Lewyllie, Wervik; José Vangheluwe, Ieper, all of Belgium

[73] Assignee: Picanol N.V.,naamloze vennootschap, Belgium

[21] Appl. No.: 592,256

[22] Filed: Oct. 3, 1990

[30] Foreign Application Priority Data

Oct. 4, 1989 [BE] Belgium ..... 8901056

[51] Int. Cl.[5] ..... D03D 47/34

[52] U.S. Cl. ..... 139/450; 139/116.2; 139/452

[58] Field of Search ..... 139/450, 452, 116.2

[56] References Cited

U.S. PATENT DOCUMENTS 4,890,649 1/1990 Takahashi ..... 139/450 X
4,915,144 4/1990 Bucher .
4,932,442 6/1990 Ishido et al. ..... 139/452 X

FOREIGN PATENT DOCUMENTS 0344848 12/1989 European Pat. Off. .
1183555 7/1989 Japan ..... 139/450

*Primary Examiner*—Andrew M. Falik
*Attorney, Agent, or Firm*—Bacon & Thomas

[57] ABSTRACT

When a weft thread is not used for weaving for a certain preset time, at least one weft length of this weft thread is automatically inserted into the shed and removed to prevent weaving errors caused because the weft thread is held too long in the insertion nozzle and consequently may be damaged. The weaving process then continues with a new length of new weft thread.

19 Claims, 4 Drawing Sheets

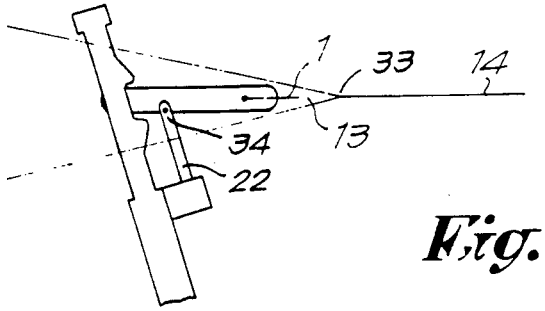
Fig. 7
Fig. 8
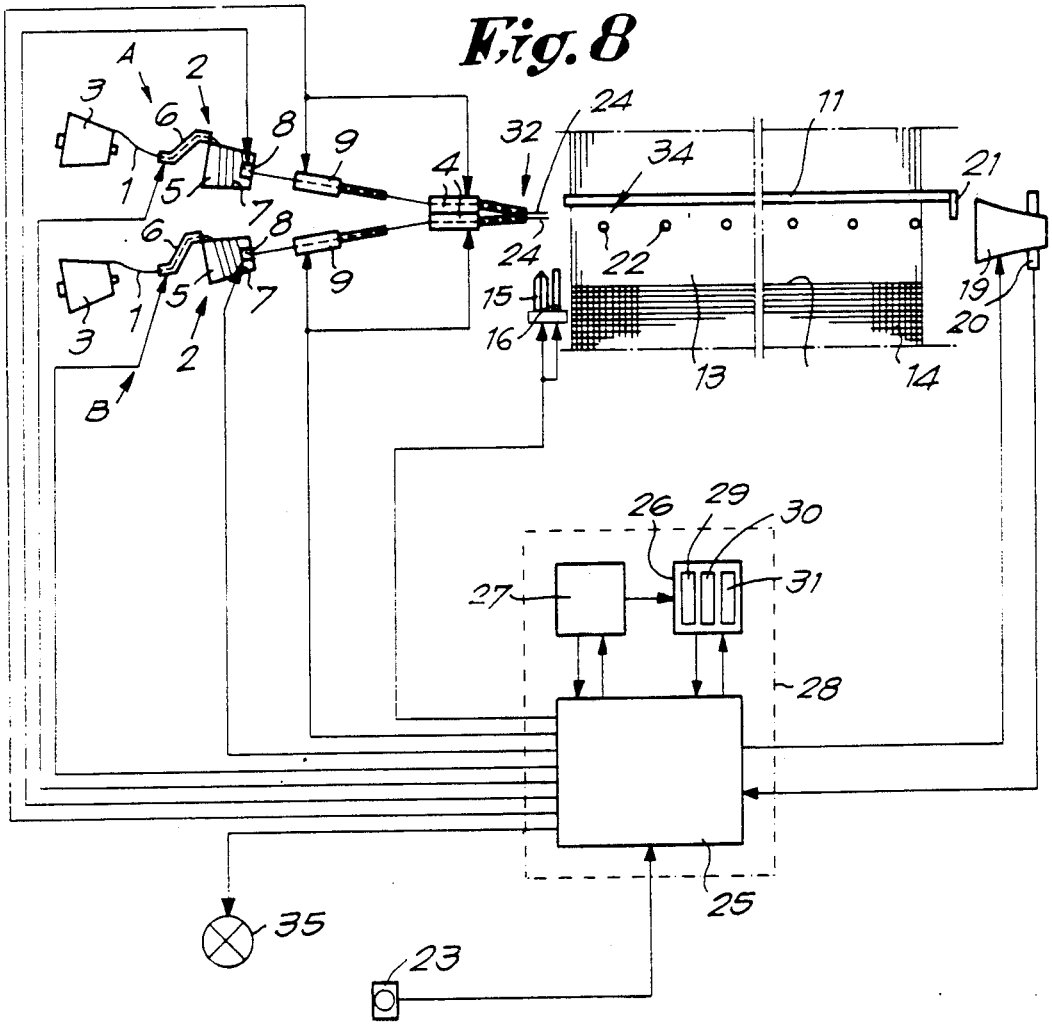

DAMAGED WEFT THREAD ELIMINATION IN AIRJET WEAVING MACHINES

BACKGROUND OF THE INVENTION

The present invention concerns a method and a device for feeding weft threads to the shed in airjet weaving machines.

As is known, in airjet weaving machines the weft threads are unspooled from bobbins by means of weft accumulators such as prewinders or similar, after which lengths of weft thread are taken from these weft accumulators and are fed to the shed by means of one or more main nozzles. The length of weft thread inserted into the shed is each time cut near the accompanying main nozzle and subsequently woven in.

In anticipation of the next thread insertion of the same weft thread, the cut thread end is held in the main nozzle by means of a weak air flow.

However, when a thread end is held in the main nozzle for too long, the top of the weft thread may be damaged, depending on the type of thread used. Such damage consists essentially of the thread being unravelled or even broken by the air flow exerted upon it for a certain period of time. As a result, a weft thread with a bad end or too short a weft thread is inserted into the shed, which results in a weaving error or a machine stop.

The problem mentioned above may occur during longer standstills of the weaving machine.

SUMMARY OF THE INVENTION

The present invention concerns a method and a device which offer a solution to the above-mentioned problem, such that only lengths of weft thread with good thread ends or thread ends with the right length are woven in.

To this end, the invention concerns a method for feeding weft threads to the shed in airjet weaving machines, characterized in that when a weft thread has not been used for weaving for a certain period of time, at least one weft length of at least this weft thread is automatically inserted into the shed and removed again from it before the weaving process is started.

As a result, the unravelled or too short a thread end is also removed by means of the fed and immediately removed weft length, while a newly cut thread end is formed at the main nozzle.

Another result is that any possible damage to the weft thread, because it has been present in the yarn clip too long, because it has been retained by the blocking pin of the prewinder too long or because the thread is untwisted, is also removed.

It is clear that this automatic operation only needs to be done for weft threads whose thread end is not resistant to a long stay in the main nozzle.

In case the weaving machine has stood still for a relatively long period of time, the method can be applied to all weft threads used in the weaving machine before the weaving process is started. When the above-mentioned method is applied to a weft thread of which one or more weft lengths are inserted into the shed only with relatively long intervals because of the weaving pattern, it is clear that the above-mentioned intervention is preferably delayed until just before the moment when a weft length of such a weft thread must be woven in.

The method according to the invention is also applied to weft threads whose waiting period has been exceeded at the moment when it must be inserted for the first time.

In order to determine whether or not the method according to the invention must be applied, the device preferably has a time switch which includes a counter which counts continuously and is reset at zero each time a new insertion of the weft thread concerned takes place, and which gives a signal when it exceeds a well-defined, preferably adjustable, value, as a result of which the method according to the invention is carried out automatically.

In order to use the method according to the invention, before starting it, the main nozzle concerned must be checked for the presence of the weft thread. If the weft thread is not present in the main nozzle, this method cannot be applied, and the main nozzle must be rethreaded manually or automatically.

If the weft thread is partly absent in the main nozzle, one winding of the prewinder is released and the weft thread in the main nozzle is pushed forward under low air pressure. Then follows another check on the presence of a weft thread and if the weft thread is present the method can be started. If not, rethreading is required.

The invention also concerns the device for realizing the above-mentioned method.

BRIEF DESCRIPTION OF THE DRAWINGS

In order to better explain the characteristics of the invention, by way of example only and without being limitative in any way, the following preferred embodiments are described with reference to the accompanying drawings, where:

FIG. 7 shows a cross-section according to line VII—VII in FIG. 6;

FIG. 8 is a schematic elevated view of a device according to the invention in case two weft threads are used;

DETAILED DESCRIPTION OF THE PREFERRED EMBODIMENTS

Figure 1:
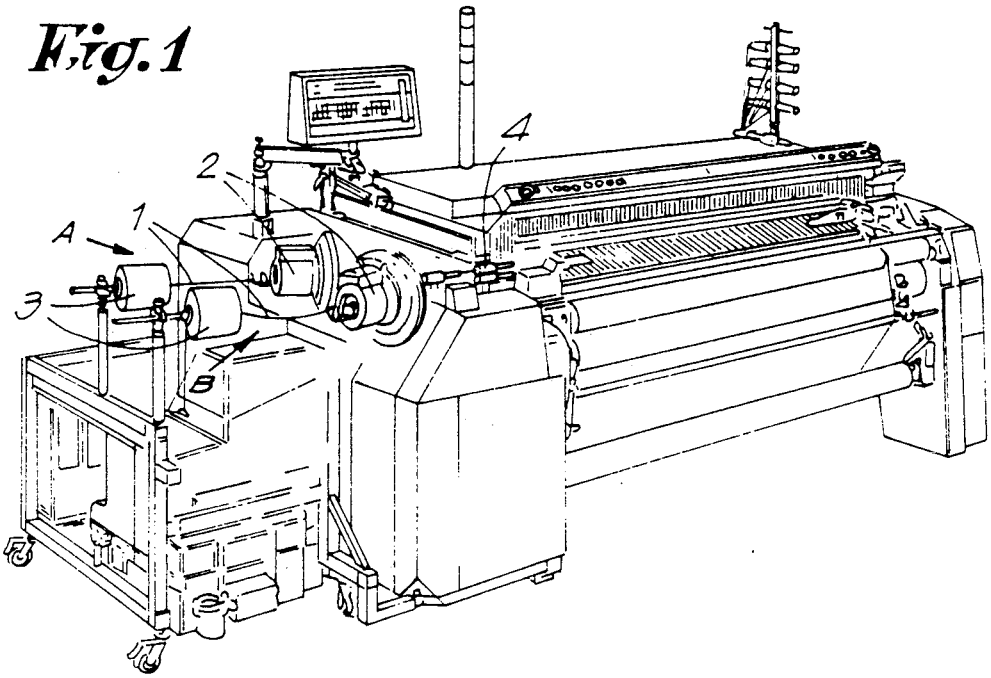
FIG. 1 is a perspective view of an airjet weaving machine equipped with a device according to the invention.

As indicated in FIG. 1, it is known that in weaving machines the weft threads 1 are unspooled from feed bobbins 3 by means of weft accumulators, such as prewinders 2, after which they are led to the main nozzles 4.

Figure 2:
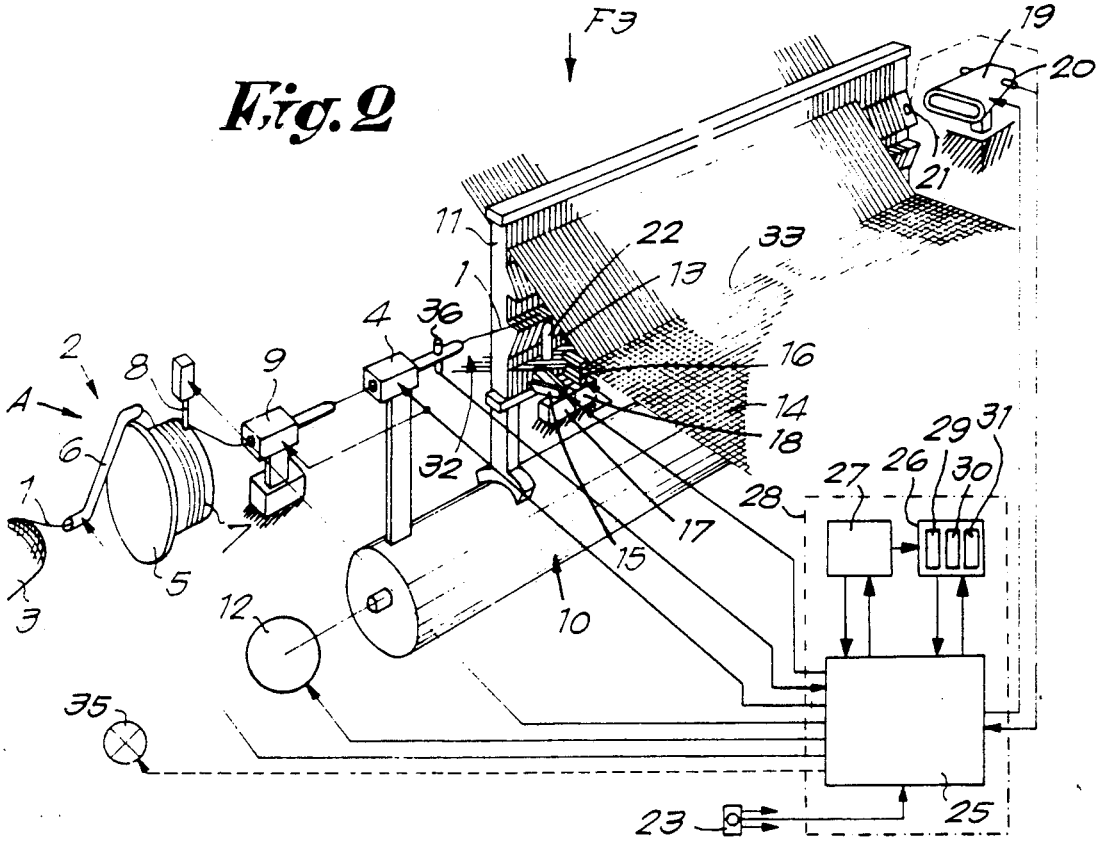
FIG. 2 shows is a partially schematic perspective view of the device according to the invention.

This is further explained in the schematic representation of FIG. 2, in which only one thread feed channel A is shown. The above-mentioned prewinder 2 consists in the known way of a fixed prewinder drum 5 and a rotating winding tube 6, whereby windings 7 wound on the prewinder drum 5 can be retained by a magnetically controlled pin 8.

Further, FIG. 2 shows an auxiliary main nozzle 9, the sley 10 with the reed 11, the sley drive 12, the shed 13, the cloth 14, the weft cutter 15, a yarn clip 16, the drives 17 and 18 of the weft cutter 15 and the yarn clip 16, a suction nozzle 19 situated opposite the main nozzle 4, a yarn detector 20 operating in conjunction with the suction nozzle 19, a yarn detector or weft detector 21 situated next to the reed 11, the relay nozzles 22 and the starting button 23 of the weaving machine.

In this embodiment, the prewinder 2, the feed bobbin 3, the auxiliary main nozzle 9, the weft cutter 15, the yarn clip 16 and the suction nozzle 19 are fixed to the frame of the weaving machine.

It is known that when the weft thread 1 is not inserted into the shed, or in other words, when the weft thread 1 is in waiting position, its end 24 is held in the main nozzle 4 by a weak air flow in the main nozzle. The thread end 24 is thereby retained in the main nozzle 4, both during standstill of the weaving machine and during the intervals between respective thread insertions.

Transport of the thread is hereby impeded, as it is stopped by means of the above-mentioned pin 8.

It is clear that the thread end 24 can unravel or even break, depending on the type of weft thread, after a certain period of time, such that the problems mentioned in the introduction may occur. Further, it is possible that the weft thread between the pin 8 and the end could be damaged or untwisted by the weak air flow.

In order to provide a solution to this problem when using yarn which easily unravels or breaks, the invention concerns a method which is characterized in that when a weft thread 1 is not used for weaving for a certain period of time, at least one weft length of this weft thread 1 is automatically inserted into the shed 13 and then removed from it before the normal weaving is continued, such that only weft threads with thread ends 24 which are still in a good state and which have the right length, can be woven in.

As represented in FIG. 2, the device according to the invention is therefore provided with a control unit 25 which controls the above-mentioned parts of the weaving machine such that the method as described above is carried out automatically.

To this end, the device also contains a time switch 26 which is preferably coupled to a unit 27, which controls the order of the weaving pattern, at least when several weft threads 1 and weft accumulators 2 are used.

The control unit 25, the time switch 26 and the unit 27 may be integral parts of the general control unit 28 of the weaving machine.

FIGS. 3 to 7 show the various steps of the method automatically carried out by the device for one thread feed channel A.

Figure 3:
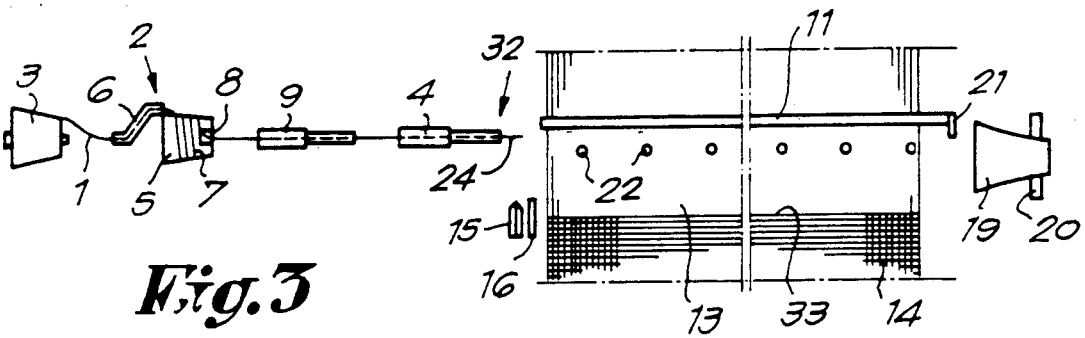
FIGS. 3 to 6 are schematic elevated views taken in the direction of arrow F3 in FIG. 2, each time for another step in the method.

FIG. 3 shows the situation whereby the thread end 24 of the weft thread 1 of the thread feed channel concerned is situated inside or just outside the main nozzle 4, in anticipation of a next weft thread length insertion into the shed 13 starting from this thread feed channel.

The time switch 26 measures the period of time during which the thread end 24 is situated in the main nozzle 4, in other words the waiting period of the thread end 24. This time switch 26 may includes a counter 29, for example with a built-in pulse generator, setting means 30 which allow setting of a reference time, and comparing means 31 to compare the value of the counter 29, which is representative of the waiting period of the thread end 24 in the main nozzle 4, with the reference time mentioned above.

The moment when the next weft thread length must be inserted starting from the thread feed channel A or during the waiting period, the time registered by the counter 29, i.e. the execution time of the counter, is compared with the set reference time. If the time registered by the counter 29 is shorter than the set reference time, the weaving process is continued as usual.

However, if the time registered by the counter 29 is longer than the above-mentioned reference time, the steps as represented in FIGS. 4 to 7 are carried out in order to form a new thread end 24.

According to a first step, an opened shed 13 is provided. The weft cutter 15 and the yarn clip 16 are brought in their opened position.

Then one winding of the weft thread is firstly inserted into the shed, preferably by means of a weak air flow. As a result, an already partly damaged thread is prevented from breaking and a thread possibly partly present in the main nozzle is prevented from being removed from it by a strong air flow, which would require a rethreading.

Figure 4:
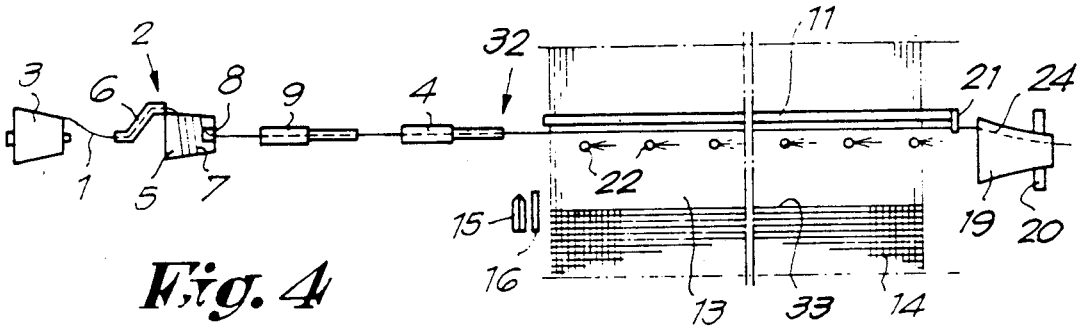

Then, as indicated in FIG. 4, one length of weft thread 1 is inserted into the shed 13, at least up to a point where this thread ends up in the suction nozzle 19 with its free thread end 24. The insertion of this length of weft thread may be done in the traditional manner by means of the main nozzle 4 and the relay nozzles 22. The insertion of the right length may be done by releasing a certain number of windings 7 from the prewinder drum 5, the arrival of the thread in the suction nozzle 19 being checked by the detector 20. According to another possibility, the pin 8 of the prewinder 2 is left open until a weft thread 1 is observed near the suction nozzle 19, for example, by the detector 21 placed near the reed 11, or by means of the thread detector 20 built into the suction nozzle 19.

It must be stated that when, as represented in the figures, a cloth 14 smaller than the total weaving width of the weaving machine is woven, a length of weft thread 1 longer than the weft length or width of the cloth must be released, such that the thread end 24 is certain to end up in the suction nozzle 19 which is fixed to the frame of the weaving machine.

It is clear that if a cloth 14 as wide as the total weaving width of the weaving machine is woven, or if the suction nozzle 19 is mounted movably such that it can be placed right next to the cloth 14, for example because it is mounted slidably on the sley, it suffices that the length of weft thread 1 to be inserted is equal to the normal length of weft thread, in other words, equal to the width of the cloth.

Figure 5:
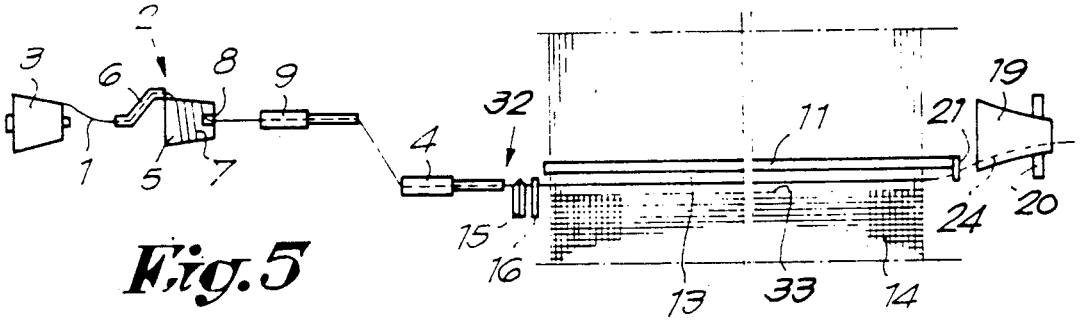

Then the length of weft thread inserted through the shed 13 is cut in front of the exit 32 of the main nozzle 4. As shown in FIG. 5, this is done by commanding the sley 10 such that the reed 11 moves forward over a certain distance, so that the weft thread 1 inserted into the shed 13 is moved to the fell line 33.

The movement of the sley must be stopped in time to prevent the weft thread 1 from being beaten against the fell line 33 and permit weft thread 1 to be brought into the opened weft cutter 15 and the clip 16. By closing the clip 16 and the weft cutter 15, the weft thread 1 is cut in front of the exit of the main nozzle 4.

Figure 6:
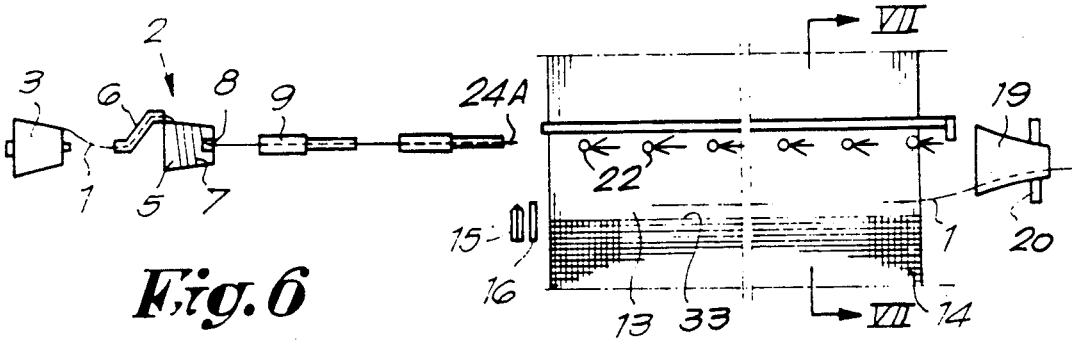

The cut length of weft thread is removed from the shed, which is preferably done, as shown in FIGS. 6 and 7, by moving the sley 10 back to a rearward position such that the relay nozzles 22 end up in the shed 13 with their blow openings 34, and such that the activation of these relay nozzles 22 as well as the traction of the suction nozzle 19 cause the cut part of the weft thread 1 to be smoothly removed from the shed 13 and picked up by the suction nozzle 19, after the clip 16 has been opened again.

Then the thread detector 20 built into the suction nozzle 19 checks if the cut weft thread has indeed been removed from the shed. If such is the case, the weaving process is then started again with a new thread end of good quality and of the right length. If such is not the case, the method is stopped with an error status and a manual intervention is required.

In case several thread feed channels A and B are used, as shown schematically in FIG. 8, the above-mentioned time switch 26 preferably comes in multiple constructions, such that for each thread feed channel the waiting period can be measured separately during which the thread ends 24 concerned are situated in the main nozzles 4. In order to set the time switches 26, in particular the respective counters, at 0, the unit 27 can be used, which controls the order of the weft threads in accordance with the weaving pattern, whereby the counter of a thread feed channel A or B is set at 0 each time a length of weft thread of the channel concerned is inserted into the shed 13.

Figure 9:
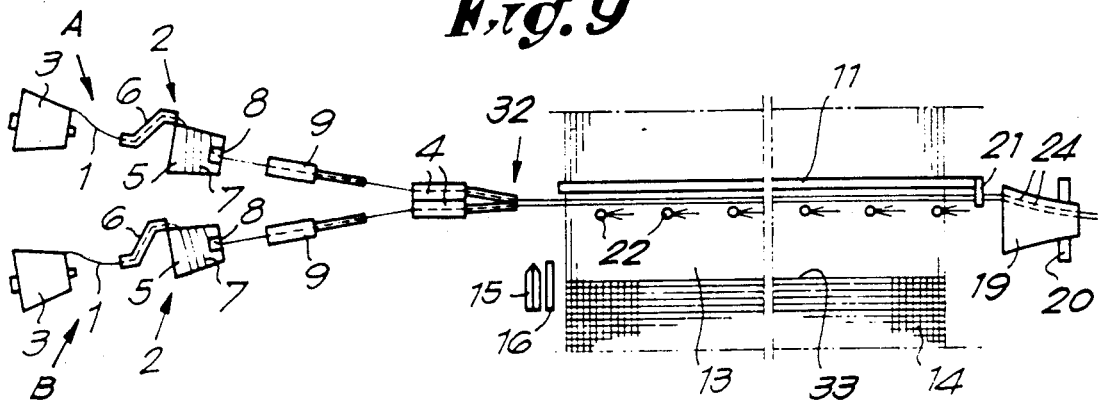
FIGS. 9 to 11 show views analogous to that of FIG. 8, each time for another step in the method according to the invention.
Figure 10:
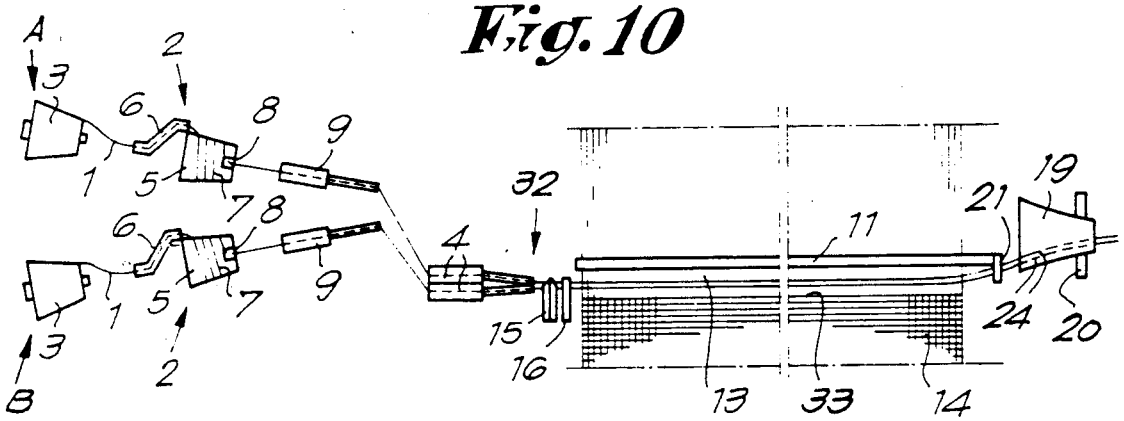
Figure 11:
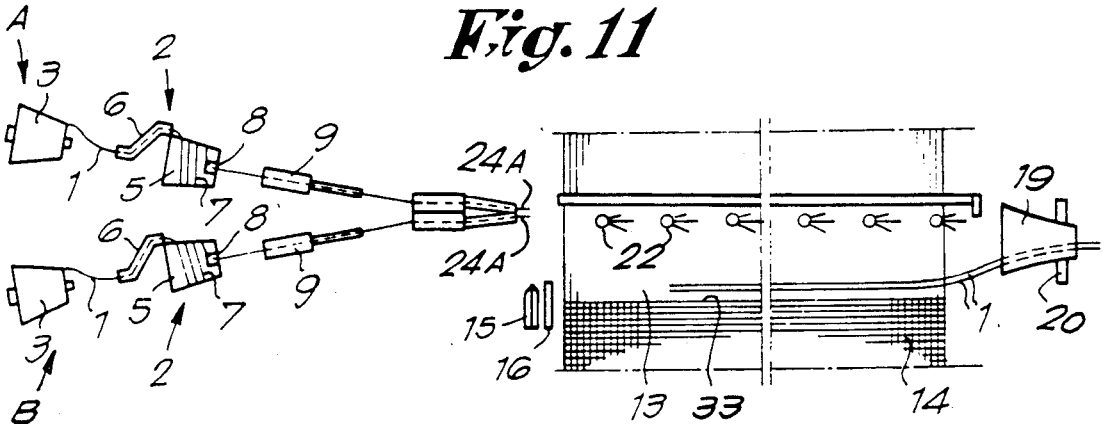

The control unit 27 is preferably constructed such that when the reference times for all thread feed channels A and B are exceeded after the standstill of the weaving machine, the method according to the invention is applied simultaneously for all weft threads 1, in particular according to the various steps shown in FIGS. 9 to 11.

According to a variant, the method can also be realized at each start of the weaving machine, taking into account the waiting periods of the weft threads in the main nozzles for all thread feed channels.

According to another variant, the control unit 25 can be constructed such that the above-mentioned method is carried out automatically for all thread feed channels at each start of the weaving machine, for example by setting the reference times for all channels at 0.

It is clear that the setting means 30 can be chosen arbitrarily. For example, they can be set once during the construction of the device, but they can also be constructed such that the above-mentioned reference time can be set by the weaver, preferably separately per thread feed channel A or B, such that an optimum time can be chosen as a function of the thread used. For a weft thread which unravels or breaks quickly, the reference time is chosen shorter than for a weft thread which unravels or breaks less quickly. The method can be omitted for thread feed channels with a weft thread which does not unravel.

The above-mentioned counter 29 can be equipped with deactivation means, such that the counter is deactivated automatically when the reference time is exceeded; indeed, in that case it suffices that a signal is given to the control unit 25, and counting is no longer necessary.

During the execution of the automatic operation mentioned above, the weaver is warned by a lamp 35 switching on.

Before the method according to the invention is carried out, the suction nozzle 19 is preferably checked automatically for dust and dirt. If not checked out automatically, nozzle 19 must be cleaned manually or automatically. The dust or dirt check may be done by means of thread detector 20.

Checking the presence of the thread in the main nozzle 4, as mentioned in the introduction, can be realized by means of a built-in detector 36.

The present invention is in no way limited to the embodiments described by way of example and shown in the drawings; on the contrary, such a method and device for feeding weft threads to the shed in airjet weaving machines can be made in various sorts of variants while still remaining within the scope of the invention.

We claim:

1. A method for feeding weft threads to the shed in an airjet weaving machine by means of which a weaving process is performed, comprising the steps of automatically inserting a length of weft thread into the shed upon determining that a waiting period during which the weft thread has not been used for weaving exceeds a predetermined length of time, and removing the automatically inserted length of weft thread from the shed before starting a weaving process.

2. A method as claimed in claim 1, wherein said steps of automatically inserting and removing a length of weft thread are carried out just before another length of said weft thread is woven into a cloth.

3. A method as claimed in claim 1, wherein the steps of automatically inserting and removing a length of weft thread are carried out during a waiting period in which the length of weft thread is not used for weaving.

4. A method as claimed in claim 1, wherein said determination that the waiting period exceeds a predetermined length of time is carried out by means of at least one time switch, and wherein the waiting period measured by the time switch is reset to zero each time a length of said weft thread is inserted.

5. A method as claimed in claim 1, further comprising the steps of feeding the weft thread in separate feed channels, and measuring said waiting period separately per feed channel.

6. A method as claimed in claim 5, wherein the steps of automatically inserting and removing a length of weft thread are carried out, at the time the weaving machine is started, for all weft threads determined to have a waiting period which exceeds said predetermined said length of time.

7. A method as claimed in claim 6, further comprising the steps of, at the start of the weaving machine, automatically inserting and removing from the shed lengths of weft thread whose waiting period does not exceed said predetermined length of time.

8. A method as claimed in claim 1, wherein said step of removing the weft length from the shed comprises the step of picking up the length of weft thread by a suction nozzle situated opposite an insertion side of the shed, cutting the length of weft thread loose at the insertion side, and subsequently removing the length of weft thread by means of said suction nozzle situated opposite the insertion side.

9. A method as claimed in claim 8, wherein the step of removing the cut length of weft thread from the shed comprises the step of activating said suction nozzle and a plurality of relay nozzles provided in the weaving machine.

10. A method as claimed in claim 8, wherein the step of cutting loose said length of weft thread comprises the steps of moving the sley of the weaving machine until the inserted length of weft thread is within reach of a weft cutter, and subsequently causing said weft cutter to cut said thread.

11. A method as claimed in claim 8, further comprising the step of automatically checking said suction nozzle for dust and the presence of a thread before carrying out the steps of inserting and removing a weft thread from the shed.

12. A method as claimed in claim 9, further comprising the step of holding a sley of the weaving machine in a rearward position while said cut length of weft thread is removed from the shed.

13. A method as claimed in claim 1, wherein the step of automatically inserting said length of weft thread comprises the step of checking, by means of a thread detector situated opposite an insertion side of the shed in respect to the direction of insertion of the weft thread, whether insertion has occurred.

14. A method as claimed in claim 13, wherein said step of checking insertion comprises the step of moving said thread detector in conjunction with a reed, said thread detector being placed at an end of said reed.

15. A method as claimed in claim 13, wherein the step of inserting the length of weft thread into the shed further comprises the steps of picking up an end of the length of weft thread in a suction nozzle, and checking insertion of the length of weft thread by means of a thread detector placed within said suction nozzle.

16. A method as claimed in claim 1, further comprising the step of automatically checking the presence of a thread in the main nozzle, and subsequently performing the steps of inserting and removing the weft thread from the shed only if a weft thread is present in the main nozzle.

17. A device for feeding weft threads to the shed in an airjet weaving machine, comprising means for inserting a weft thread into a shed from a feed bobbin via a weft accumulator and a main nozzle, a sley drive, a time switch including means for measuring a waiting period of a weft thread in the main nozzle and for giving a signal when a predetermined period of time is exceeded by the waiting period, and control unit means for causing at least one weft length of the weft thread to be inserted into the shed and subsequently removed from the shed upon receipt of said signal, and for starting a weaving process after said weft thread has been inserted and removed from the shed.

18. A device as claimed in claim 17, wherein said time switch is coupled to means for checking the order of the weaving pattern, and further comprising means for feeding the weft thread in separate thread feed channels, means for resetting an execution time of a respective time switch accompanying one of said thread feed channels to zero each time a weft length of the weft thread concerned is woven in a cloth.

19. A device a claimed in claim 18, wherein said time switch comprises counter means including a counter for giving a signal representative of an execution time of said counter, setting means for allowing the setting of a predetermined reference time, and comparing means for comparing the execution time of the counter with said reference time and for giving a signal to the control unit means as soon as the execution time exceeds the reference time.

* * * * *